US006082008A

United States Patent [19]

Lariviere, Jr.

[11] Patent Number: 6,082,008

[45] Date of Patent: Jul. 4, 2000

[54] KNIFE FOR MOVING ALONG A CHANNEL IN A TEMPLATE TO FORM A PUZZLE PIECE FROM AN UNDERLYING WORKPIECE

[76] Inventor: Richard L. Lariviere, Jr., 17 Jay's La., Hanover, Mass. 02339

[21] Appl. No.: 09/207,133

[22] Filed: Dec. 8, 1998

[51] Int. Cl.[7] ..... B26B 1/02

[52] U.S. Cl. ..... 30/294; 30/289

[58] Field of Search ..... 30/368, 164.9, 30/289, 294, 337, 330, 317

[56] References Cited

U.S. PATENT DOCUMENTS

| | | | |
|---|---|---|---|
| 2,569,286 | 9/1951 | Bunker | 30/329 |
| 2,803,877 | 8/1957 | Belanger | 30/125 |
| 3,080,653 | 3/1963 | Dolin | 30/317 |
| 3,886,656 | 6/1975 | Meshulam et al. | 30/164.9 |
| 3,977,077 | 8/1976 | Rebold | 30/317 X |
| 5,865,928 | 2/1999 | Lariviere, Jr. et al. | 156/256 |

*Primary Examiner*—M. Rachuba
*Assistant Examiner*—Dominic Troiano
*Attorney, Agent, or Firm*—Pandiscio & Pandsicio

[57] ABSTRACT

A knife for drawing along a cutting channel in a template defining a puzzle piece outline, so as to cut an underlying workpiece along lines conforming to the shape of the puzzle piece outline to form a puzzle piece from the workpiece. The knife includes a handle portion, a hollow nose portion mounted on the handle portion, a blade mounting portion contained by the nose portion and rotatable therein and extending distally therefrom, and a cutting blade mounted on the blade mounting portion and extending distally therefrom. The cutting blade includes a leading edge, a longer trailing edge, and a cutting edge extending therebetween. In its preferred form the knife includes a shield that is disposed forwardly of the leading edge of the cutting blade and extends along at least a portion of the length of the leading edge of that blade. The cutting blade and shield are dimensioned to enter and move along the cutting channel of a template, with the cutting edge engaging the workpiece for the forming of the puzzle piece and the shield coacting with the sides of the channel to prevent the cutting edge from cutting into the template.

13 Claims, 3 Drawing Sheets

KNIFE FOR MOVING ALONG A CHANNEL IN A TEMPLATE TO FORM A PUZZLE PIECE FROM AN UNDERLYING WORKPIECE

FIELD OF THE INVENTION

The present invention relates to cutting instruments and is directed more particularly to a knife for moving along a channel in a template to form a puzzle piece from an underlying workpiece.

BACKGROUND OF THE INVENTION

It is known to use transparent templates, swivel blade knives, and flat graphic art objects mounted on adhesive coated substrates to produce picture puzzle pieces. The templates are formed with a plurality of through cuts that form channels which define outlines of a plurality of puzzle pieces. The channels are interrupted and interconnected by webs to prevent the puzzle pieces patterns from separating from the template. The widths of the channels are established according to the thickness of the knife blade so as to permit the knife blade to enter the channels and move therethrough, but to limit side to side movement of the knife blade, to assure that the cuts made by the knife are exact. The linear patterns of the channels are configured to accommodate the turning ability of the knife blade, allowing the blade to advance freely. By aligning a workpiece, comprising a photograph, or other flat graphic art object mounted on a substrate, under the template, puzzle pieces can be cut from the photograph or other graphic art object.

The template preferably is of a clear, transparent material. The knife preferably is a swivel knife which cuts the photograph or other graphic art object and the substrate along lines corresponding to the channels in the template. The knife is dimensioned to fit into and follow the configuration of the channels in the template. The substrate is adhesively coated, such that the graphic art object may be adhered thereto prior to cutting. The adhesive layer of the substrate is pressure sensitive and bonds the back of the graphic art object to the substrate. The cutting depth of the knife blade is sufficient to penetrate the thickness of the template, the photograph or other graphic art object, and the adhesive-coated substrate, to provide a picture puzzle piece of laminated structure.

After cutting along the template channel, a straight knife may be used to complete the outline of the puzzle piece and thereby separate the puzzle piece from the workpiece.

Referring to FIG. 1, it will be seen that the swivel knife 10 may include a handle portion 12 for manipulation by an operator, which may be a person or a machine, and a knife blade 14 that is mounted on the handle portion 12 so that the blade is capable of a swivel motion relative to the handle, that is, such that the blade 14 can rotate on the axis of the handle portion 12 of the knife 10.

Referring still to FIG. 1, assume that a puzzle piece is to be produced conforming in shape and size to puzzle piece pattern 16 in a template 18, the pattern being defined by channels 20*a*–20*c*. The knife blade 14 is positioned in one of the channels 20*a*–20*c*, such as channel 20*a*, such that the knife blade penetrates completely through the template 18 and a workpiece 22, which includes the graphic art object 24 and the substrate 26 to which the art object 24 is adhered by a layer of adhesive 28. The knife blade 14 is then drawn along the length of the channel 20*a*, and thereafter along the lengths of the channels 20*b* and 20*c*.

The template 18 is removed, leaving the workpiece 22 with cuts corresponding to the channels 20*a*–20*c*. The webs between the cuts are then severed, as by a straight knife (not shown) to permit separation of the puzzle piece from the remainder of the workpiece. The foregoing procedure is repeated to produce additional interlocking puzzle pieces.

The method described briefly above, and the components of the assembly, and knife, are shown and described in detail in U.S. patent application Ser. No. 08/905,989, filed Aug. 5, 1997, in the name of Richard L. Lariviere, Jr., et al.

While the above-described method and components have satisfactorily produced a large number of picture puzzles, it has been found that on occasion the knife blade 14, as it travels along the channels, and particularly when encountering a relatively sharp bend in a channel, bites into a side of the channel, damaging the template 18 and/or blade 14.

Accordingly, there is a need for a knife blade of the type described above, provided with means for preventing the blade from cutting engagement with the walls of the channel through which the blade is drawn.

OBJECTS OF THE INVENTION

It is, therefore, an object of the invention to provide a knife for drawing along a channel in a template and having means for shielding the leading edge of the blade of the knife from engagement with a wall of the channel.

BRIEF DESCRIPTION OF THE PRESENT INVENTION

With the above and other objects in view, as will hereinafter appear, a feature of the present invention is the provision of a knife for drawing along a channel in a template, the channel defining a puzzle piece outline, so as to cut an underlying workpiece along lines conforming to the shape of the puzzle piece outline to form a puzzle piece from the workpiece. The knife comprises a handle portion for manipulation by an operator, a hollow nose portion mounted on the handle portion and disposed axially of the handle portion, a blade mounting portion contained by the nose portion and rotatable therein and extending distally therefrom, and a cutting blade mounted on the blade mounting portion and extending distally therefrom. The cutting blade is provided with a leading edge, a trailing edge longer than the leading edge, and a cutting edge extending from a distal-most portion of the leading edge to a distal-most portion of the trailing edge. A shield is disposed forwardly of the leading edge and extends along at least a portion of the length of the leading edge. The blade and the shield are dimensioned to enter the channel and move through the channel with the cutting edge engaging the workpiece for the forming of the puzzle piece.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Like numerals in the several figures are intended to identify like components or elements.

DETAILED DESCRIPTION OF THE INVENTION

Figure 2:
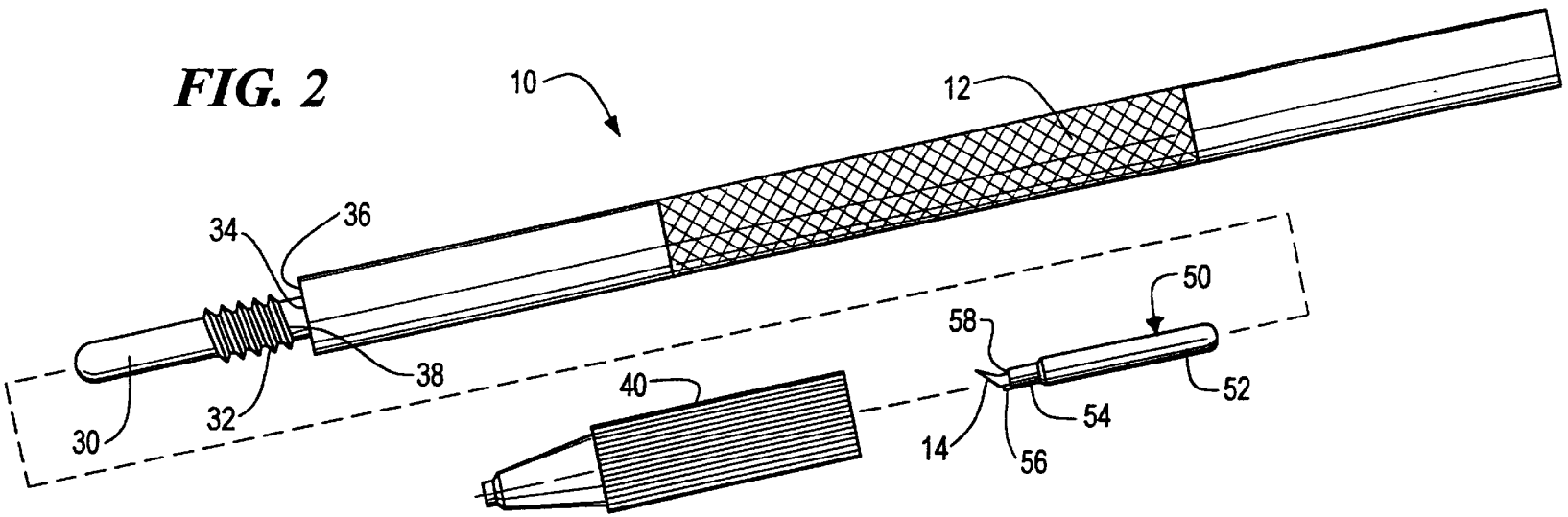
FIG. 2 is an exploded elevational view of one form of an improved knife illustrative of an embodiment of the invention.

Referring to FIG. 2, it will be seen that the knife 10 includes the handle portion 12, which may be of solid metal construction, having an elongated distal projection 30 of reduced diameter, and proximal thereof a threaded neck portion 32. A distal end 34 of the handle portion 12 defines a shoulder 36 adjacent a proximal end 38 of the threaded neck portion 32.

Figure 3A:
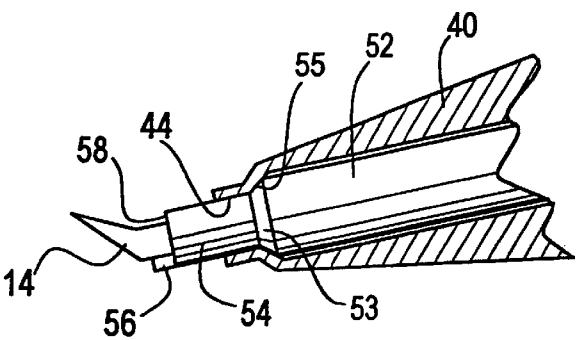
FIG. 3A is an enlarged sectional view of a portion of the knife of FIG. 3.
Figure 3:
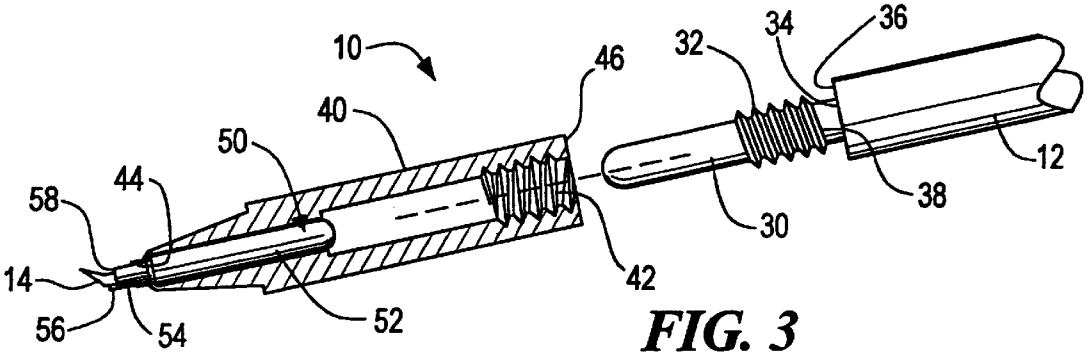
FIG. 3 is an exploded, in part sectional, view of the knife of FIG. 2.

As may be seen in FIG. 3, a hollow internally threaded nose portion 40 may be mounted on the handle 12 by insertion of the handle elongated distal projection 30 into the nose portion 40 and threaded engagement between the handle threaded neck portion 32 and internal threads 42 of the nose portion 40. The nose portion 40 is provided with a central distal opening 44.

Figure 5:
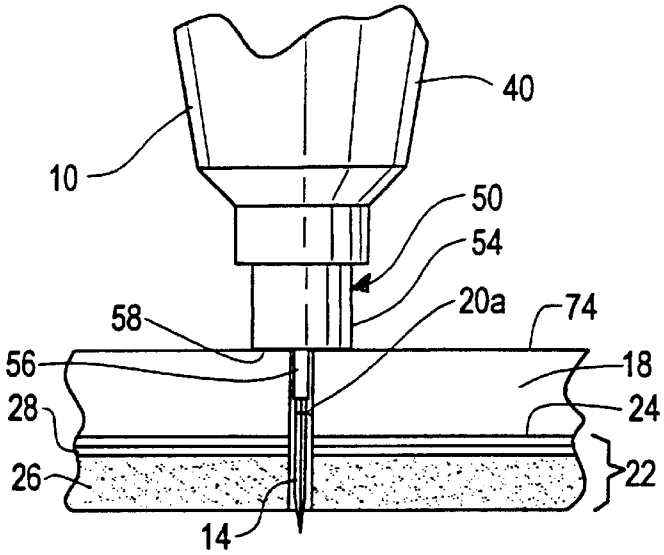
FIG. 5 is a front elevational view of a portion of the knife of FIG. 3, illustrated in conjunction with the template and workpiece shown in section.

The knife 10 further includes a blade mounting portion 50 including a generally cylindrically-shaped body 52, a collar 54 extending distally from the body 52, and a narrow protuberance 56 extending distally from and formed integral with the collar 54. As shown in FIG. 3A, the blade mounting portion body 52 fits loosely within the hollow nose portion 40, and the blade mounting portion collar 54 extends loosely through the nose portion distal opening 44. The body 52 is provided with an annular shoulder 53 which engages a complementarily configured abutment 55 internally of the nose portion 40. The body 50 is retained in axial position by the abutment 55 and the distal projection 30. The collar 54 is provided with a distal annular end surface 58 having a diameter exceeding the width of the channels 20*a*–20*c*, such that the collar 54 cannot enter the channels (FIGS. 4 and 5).

Figure 4:
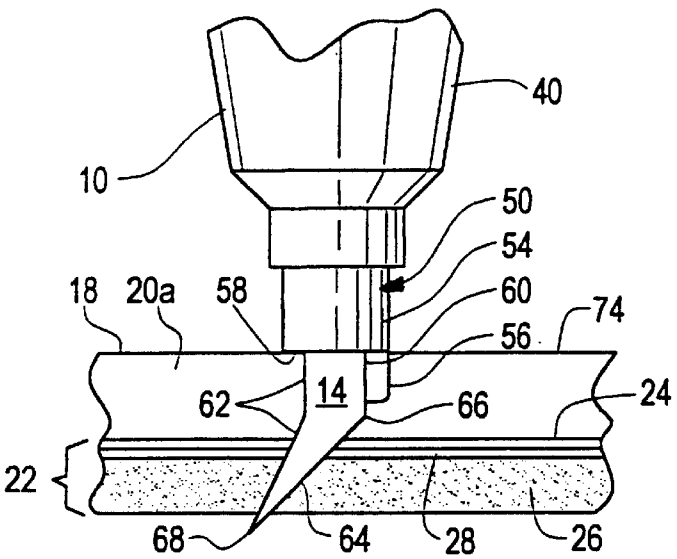
FIG. 4 is a side elevational view of a portion of the knife of FIG. 3, illustrated in conjunction with the template and workpiece shown in section.

The knife 10 further includes the cutting blade 14 fixed in the blade mounting portion 50 and extending distally therefrom (FIG. 4). The cutting blade 14 is provided with a leading edge 60, a trailing edge 62 longer than the leading edge, and a cutting edge 64 extending from a distal-most portion 66 of the leading edge 60 to a distal-most portion 68 of the trailing edge 62.

Figure 6:
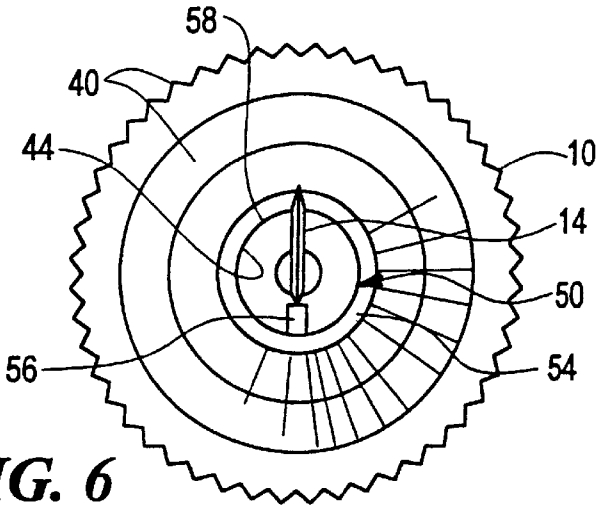
FIG. 6 is a distal end view of the knife of FIGS. 2–5.

The protuberance 56 serves as a shield and is disposed forwardly of the leading edge 60 of the cutting blade 14, and extends along at least a portion of, and preferably along a majority of, the length of the blade leading edge 60. Protuberance 56 preferably has a width (measured horizontally in FIG. 6) that is as great as, or greater than, the width of blade 14.

Figure 1:
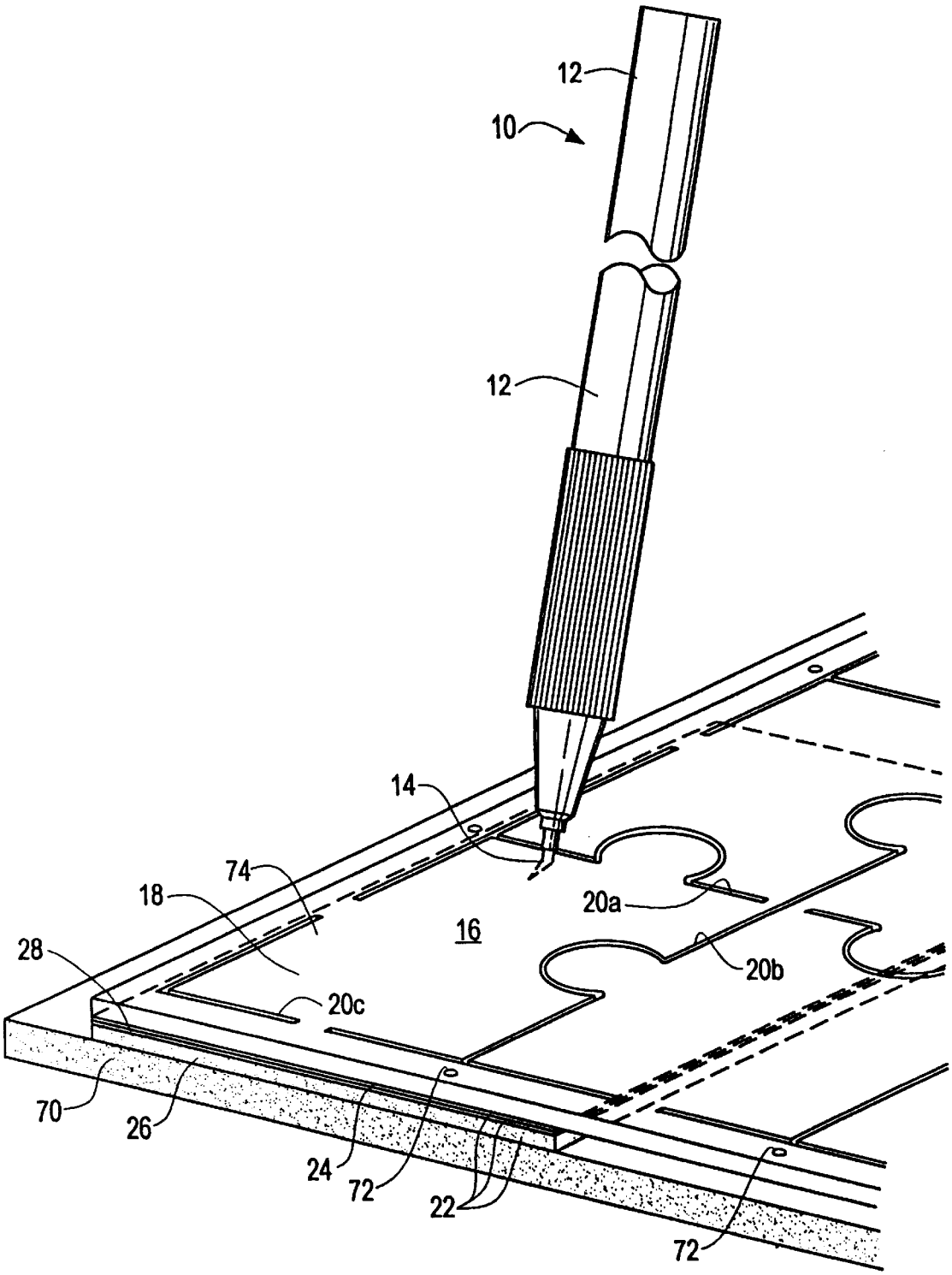
FIG. 1 is a perspective view of a cutting board, workpiece, template, and knife in combination.

In operation, the knife 10 is assembled by placing the blade mounting portion 52, with blade 14 mounted therein, in the hollow nose portion 40, with the blade mounting portion collar 54 disposed in nose portion distal opening 44, as shown in FIG. 3. The handle elongated distal projection 30 is entered into the hollow nose portion 40 through an open proximal end 46 thereof until the handle threaded neck portion 32 engages the nose portion internal threads 42. The nose portion 40 is then threaded onto the handle threaded neck portion 32 until the nose portion proximal end 46 engages the handle shoulder 36. Thereafter, the workpiece 22 is assembled and placed on a cutting board 70 (FIG. 1). The template 18 is placed over the workpiece 22. This entire assembly may be connected together, as by pins (not shown) inserted through pin holes 72. By manipulation of the knife handle portion 12 by a person or machine, the knife cutting blade 14 is caused to enter a selected template channel, such as channel 20*a*, and is drawn along the channel, cutting the graphic art object 24, and the substrate 26 adhesively bound thereto.

The collar distal surface 58 rides along an upper surface 74 (FIGS. 4 and 5) of the template 18, while the cutting blade 14 and shield 56 reside in the selected channel. The blade mounting portion 50, being loosely contained in the nose portion 40, is able to rotate in the nose portion 40, permitting the blade 14 to follow the contours defined by the channels 20*a*–20*c*, etc. The shield 56, being part of the blade mounting portion 50, moves with the blade 14 and always precedes the blade leading edge 60 in its travels through the channels of the template. Preferably, the blade mounting portion 50 is of a plastics material and the shield 56 slides along the channel, engaging any side wall surfaces which, because of sharp turns, or the like, would be engaged by the blade leading edge were it not for the presence of the shield 56. Thus, the shield 56 prevents the blade from engaging walls of the template channels, thereby preventing damage to the template and/or the blade.

Figure 7:
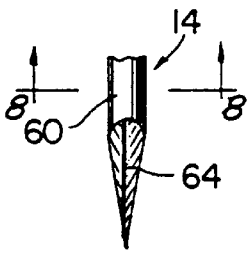
FIG. 7 is a fragmentary front elevational view of a modified form of knife blade.
Figure 8:
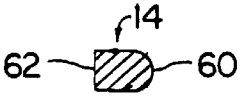
FIG. 8 is a cross-sectional view of the same modified form of knife blade taken substantially along line 8—8 of FIG. 7 through its leading edge and the proximal portion of its trailing edge.

FIG. 7 and 8 illustrate a modification of the invention which omits shield 56. FIG. 7 is a fragmentary front elevational view of the knife blade and FIG. 8 is cross-sectional view of the upper (proximal) portion of the modified knife blade. In this case the need for shield 56 is eliminated by rounding the leading edge 60, as seen best in FIG. 8. The rounding of leading edge 60 may be accomplished by burnishing the knife blade or by coining during formation of the knife by a stamping process. The rounding of leading edge 60 assures that it will slide easily along a cutting channel in a template and prevents that edge from digging into the sides of the cutting channel, thereby assuring a smooth cutting action. In this connection it should be noted that the width of the knife blade at its leading edge at least equals and preferably exceeds the maximum thickness of that portion of the cutting blade that forms the cutting edge.

It is to be understood that the present invention is by no means limited to the particular construction herein disclosed and/or shown in the drawings, but also comprises any modifications or equivalents within the scope of the claims. In this connection it should be noted that the knife of this invention is not limited in use to making puzzle pieces. Thus, for example, it may be used with a template having cutting channels similar to those herein described and illustrated for cutting graphic art objects, or other objects to a desired shape or size, for the purpose of mounting the cut objects for display or for preservation in scrapbooks. Also in using the knife of this invention to make puzzle pieces, for example, the workpiece need not include a substrate as shown at 26. Similarly it is not necessary for the template to have pin holes 72. Still other changes or uses will be obvious to persons skilled in the art.

What is claimed is:

1. A knife for drawing along a channel of predetermined width in a template, the channel defining a portion of a selected geometric pattern, so as to cut an underlying workpiece along lines conforming to the shape of said selected geometric pattern, said knife comprising: p1 a handle portion for manipulation by an operator;

a hollow nose portion mounted on said handle portion and disposed axially of said handle portion;

a blade mounting portion contained by said nose portion and rotatable therein and extending distally therefrom;

a cutting blade mounted on said blade mounting portion and extending distally from said blade mounting portion, said blade having a leading edge, a trailing edge longer than said leading edge, and a cutting edge extending from a distal-most portion of said leading edge to a distal-most portion of said trailing edge; and a shield comprising an elongated protuberance extending distally from said blade mounting, said shield being disposed forwardly of said leading edge and extending along at least a portion of the length of said leading edge, with said cutting edge being exposed for cutting;

wherein said blade and said shield are dimensioned to enter the channel and move therethrough with said cutting edge engaging the workpiece for cutting the workpiece to the shape of the selected geometric pattern.

2. The knife in accordance with claim 1 wherein said blade mounting portion is provided with a cylindrical collar having a distal end surface for engaging the template, an outside diameter of said distal end surface of said collar exceeding the width of the channel, such that said collar is prevented from entering the channel.

3. The knife in accordance with claim 2 wherein said collar extends through a distal opening in said nose portion and said protuberance is integral with said collar and extends from said distal end surface of said collar.

4. The knife in accordance with claim 1 wherein said shield abuts said leading edge of said blade and has a width greater than the thickness of said blade at said leading edge, said trailing edge and said cutting edge.

5. The knife in accordance with claim 1 wherein said shield extends along a major portion of the length of said leading edge and terminates short of said cutting edge.

6. The knife in accordance with claim 1 wherein said blade mounting portion is made of a plastics material and said shield is an integral part of said blade mounting portion.

7. The knife in accordance with claim 1 wherein said shield has a width equal to or exceeding the thickness of said cutting blade.

8. The knife in accordance with claim 1 wherein said cutting edge extends at an obtuse angle to said leading edge.

9. The knife in accordance with claim 8 wherein a first portion of said trailing edge extends parallel to said leading edge and a second portion of said trailing edge extends at an obtuse angle to said leading edge and at an acute angle to said cutting edge.

10. A swivel blade knife for insertion and cutting along a channel of predetermined width in a template, the channel defining a portion of a selected geometric pattern, so as to cut an underlying workpiece along lines conforming to the shape of said selected geometric pattern, said knife comprising:

a handle portion for manipulation by an operator;

a hollow nose portion having a proximal end and a distal end, with said proximal end being removably attached to said handle portion and said distal end being disposed axially of said handle portion;

a blade mounting portion comprising a cylindrical body portion and a cylindrical collar portion, said body portion being disposed within and rotatable relative to said nose portion and said collar portion projecting from said distal end of said nose portion;

a cutting blade having an end portion that is attached to said collar portion, said cutting blade extending distally from said collar portion and being characterized by a leading edge, a trailing edge longer than said leading edge, and a cutting edge extending from a distal-most portion of said leading edge to a distal-most portion of said trailing edge, said cutting blade end portion having a maximum dimension transverse to the axis of said blade mounting portion that is less than the outside diameter of said collar portion; and a shield in the form of a protuberance that is an integral part of said collar portion, said protuberance being disposed forwardly of and adjacent to said leading edge and extending parallel to the axis of said blade mounting portion along at least a portion of the length of said leading edge, said protuberance having a width at least equal to or exceeding the thickness of said cutting blade.

11. A knife according to claim 10 wherein said protuberance has a thickness less than the outside diameter of said collar portion.

12. A knife according to claim 10 wherein said collar portion has a diameter where it projects from said distal end of said nose portion that exceeds the width of said channel, and further wherein said blade and said shield are sized to enter said channel and move therethrough and said cutting blade is long enough for said cutting edge to engage said underlying workpiece for cutting the workpiece to the shape of the selected geometric pattern.

13. In combination with a template having a channel of predetermined width defining a portion of a selected geometric pattern and a workpiece underlying said template, a knife for insertion into and movement along said channel so as to cut said underlying workpiece along lines conforming to the shape of said selected geometric pattern, said knife comprising:

a handle portion for manipulation by an operator;

a hollow nose portion mounted on said handle portion and disposed axially of said handle portion;

a blade mounting portion contained by said nose portion and rotatable therein and extending distally therefrom;

a cutting blade mounted on said blade mounting portion and extending distally from said blade mounting portion, said blade having a leading edge, a trailing edge longer than said leading edge, and a cutting edge extending from a distal-most portion of said leading edge to a distal-most portion of said trailing edge; and a shield comprising an elongated protuberance extending distally from said blade mounting, said shield being disposed forwardly of said leading edge and extending along at least a portion of the length of said leading edge, with said cutting edge being exposed for cutting;

wherein said blade and said shield are dimensioned to enter the channel and move therethrough with said cutting edge engaging the workpiece for cutting the workpiece to the shape of the selected geometric pattern.

* * * * *

UNITED STATES PATENT AND TRADEMARK OFFICE

CERTIFICATE OF CORRECTION

PATENT NO. : 6,082,008
DATED : July 4, 2000
INVENTOR(S) : Richard L. Lariviere, Jr.

It is certified that error appears in the above-identified patent and that said Letters Patent is hereby corrected as shown below:

Column 5,
Line 8, delete "pl"; and
Line 8, the word "a" should start a new paragraph.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*